US005278368A

United States Patent [19]

Kasano et al.

[11] Patent Number: 5,278,368

[45] Date of Patent: Jan. 11, 1994

[54] ELECTROSTATIC RELAY

[75] Inventors: Fumihiro Kasano, Sakai; Hiromi Nishimura, Takatsuki; Jun Sakai, Osaka; Koichi Aizawa, Ikoma; Keiji Kakite, Hirakata; Takayoshi Awai, Kadoma, all of Japan

[73] Assignees: Matsushita Elec. Works, Ltd, Osaka, Japan; Dider Perino, Rheil Malmaison; Jacques Lewiner, Saint Cloud, both of France

[21] Appl. No.: 903,077

[22] Filed: Jun. 23, 1992

[30] Foreign Application Priority Data

| | | | |
|---|---|---|---|
| Jun. 24, 1991 | [JP] | Japan | 3-151920 |
| Jun. 24, 1991 | [JP] | Japan | 3-151923 |
| Jun. 25, 1991 | [JP] | Japan | 3-153537 |
| Jun. 25, 1991 | [JP] | Japan | 3-153538 |

[51] Int. Cl.[5] ..... H01H 57/00

[52] U.S. Cl. ..... 200/181; 361/207

[58] Field of Search ..... 200/181, 339; 361/207; 307/138

[56] References Cited

U.S. PATENT DOCUMENTS

| | | | |
|---|---|---|---|
| 4,078,183 | 3/1978 | Lewiner et al. | 200/181 X |
| 4,163,162 | 7/1979 | Micheron | 200/181 X |
| 4,480,162 | 10/1984 | Greenwood | 200/181 |
| 4,543,515 | 9/1985 | Suzuki | 200/339 X |
| 4,843,200 | 6/1989 | Parlatore et al. | 200/339 X |
| 5,051,643 | 9/1991 | Dworsky et al. | 200/181 X |

FOREIGN PATENT DOCUMENTS

| | | |
|---|---|---|
| 2814533 | 10/1978 | Fed. Rep. of Germany . |
| 2294535 | 12/1974 | France . |
| 2095911A | 10/1982 | United Kingdom . |

OTHER PUBLICATIONS

Peterson, K. E., *Micromechanical Membrane Switches on Silicon*, "IBM J. Res. Develop.", vol. 23, No. 4, Jul. 1979.

*Primary Examiner*—Renee S. Luebke

*Attorney, Agent, or Firm*—Armstrong, Westerman, Hattori, McLeland & Naughton

[57] ABSTRACT

An electrostatic relay essentially comprises a fixed electrode with a fixed contact insulated therefrom, a movable electrode plate with a movable contact insulated therefrom, and a fixed pair of oppositely charged electrets. The movable electrode plate is pivotally supported at a pivot in a cantilever fashion or a seesaw fashion, and also to move about the pivot axis relative to the fixed electrode between two rest positions of closing and opening the contacts. A control voltage source is connected across the fixed electrode and the movable electrode plate to generate a potential difference therebetween. The electrets are disposed adjacent the movable electrode plate to generate electrostatic forces attracting and repelling the movable electrode plate, respectively, when the movable electrode plate is charged to a given polarity. That is, the attracting and repelling forces are cooperative to produce a torque for moving the movable electrode plate in one direction from one of the rest positions to the other. The electrostatic relay is useful for precisely and rapidly operating the relay.

14 Claims, 14 Drawing Sheets

FIG.6A
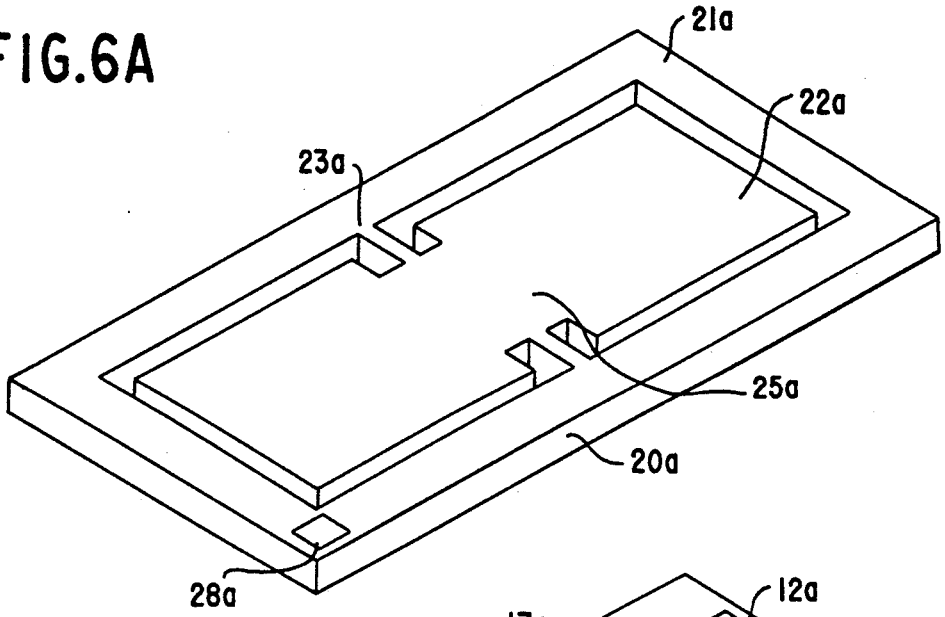
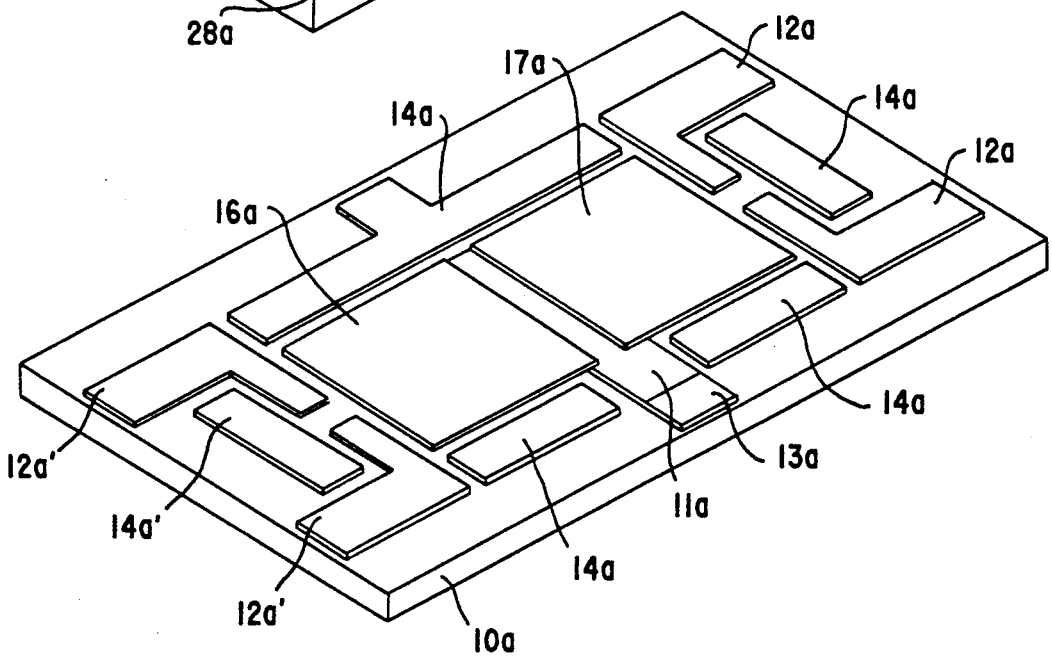
FIG.6B

FIG.12A
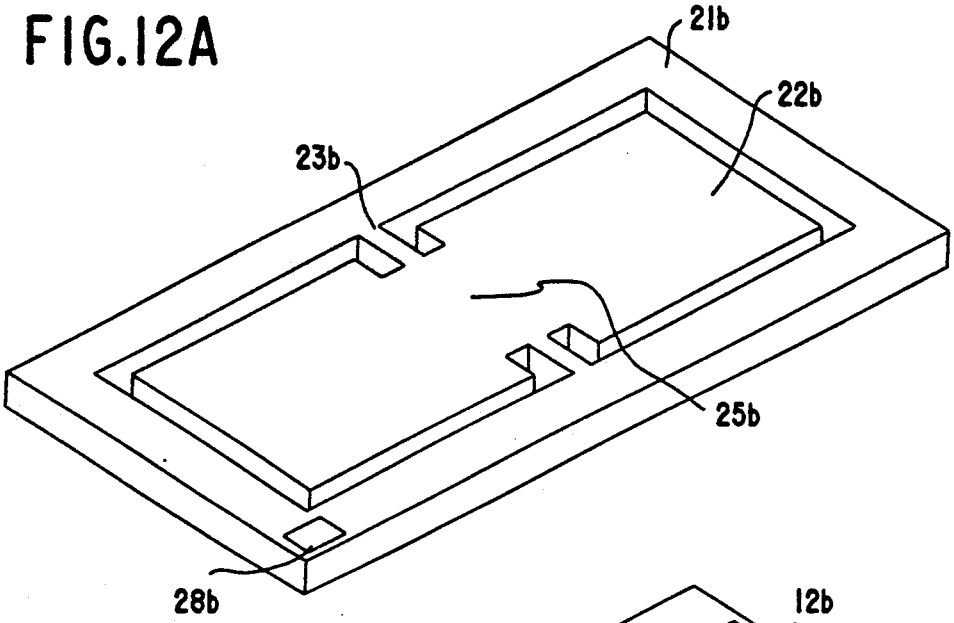
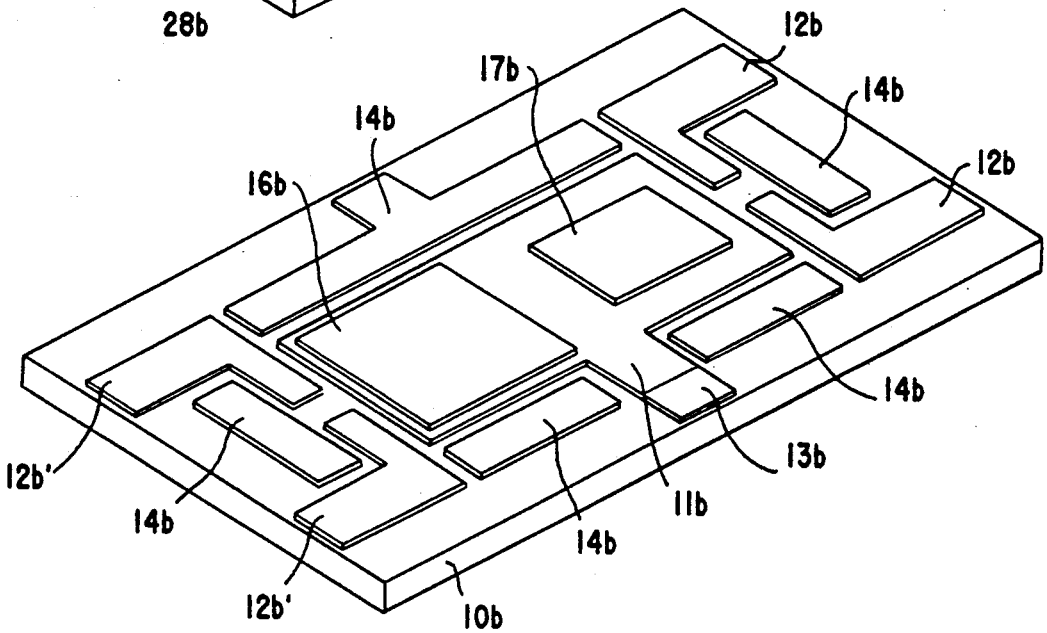
FIG.12B

FIG.15A
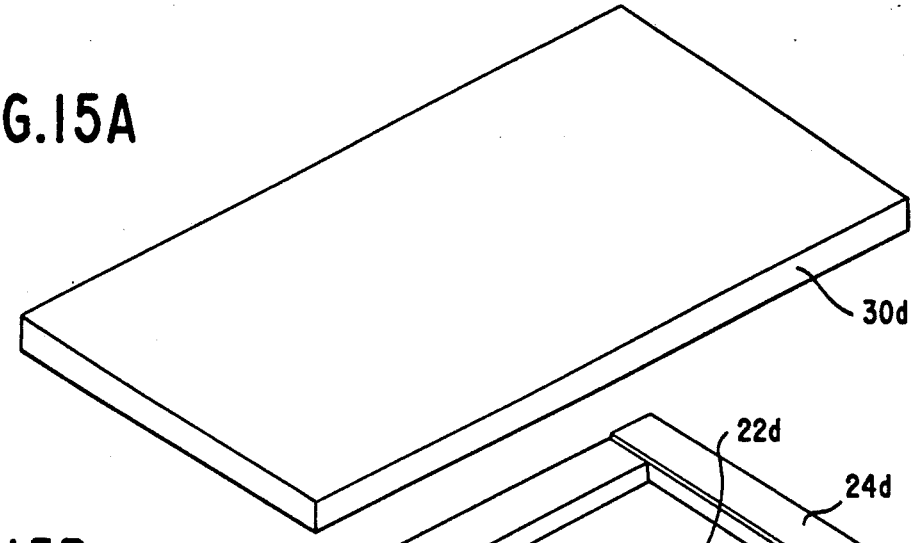
FIG.15B
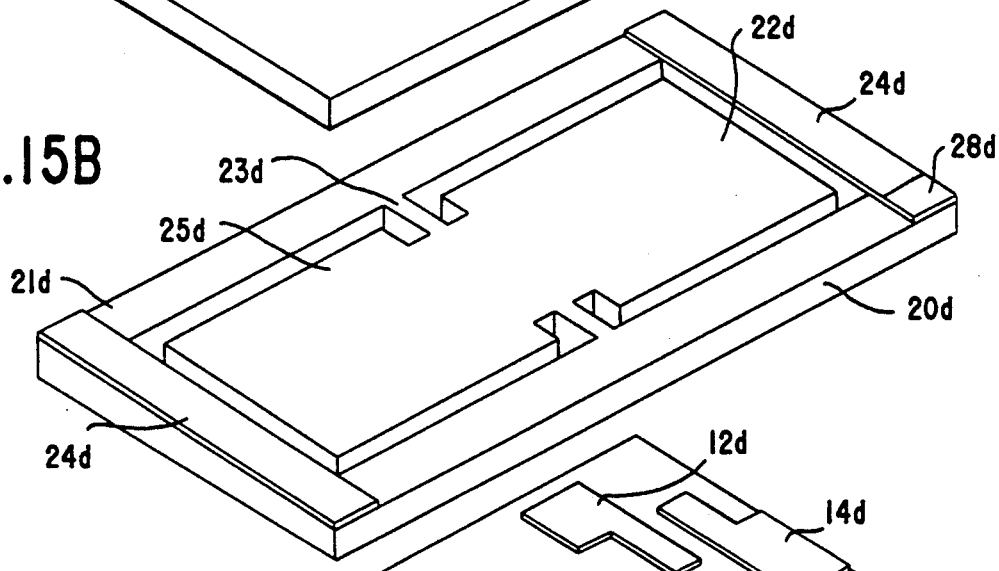
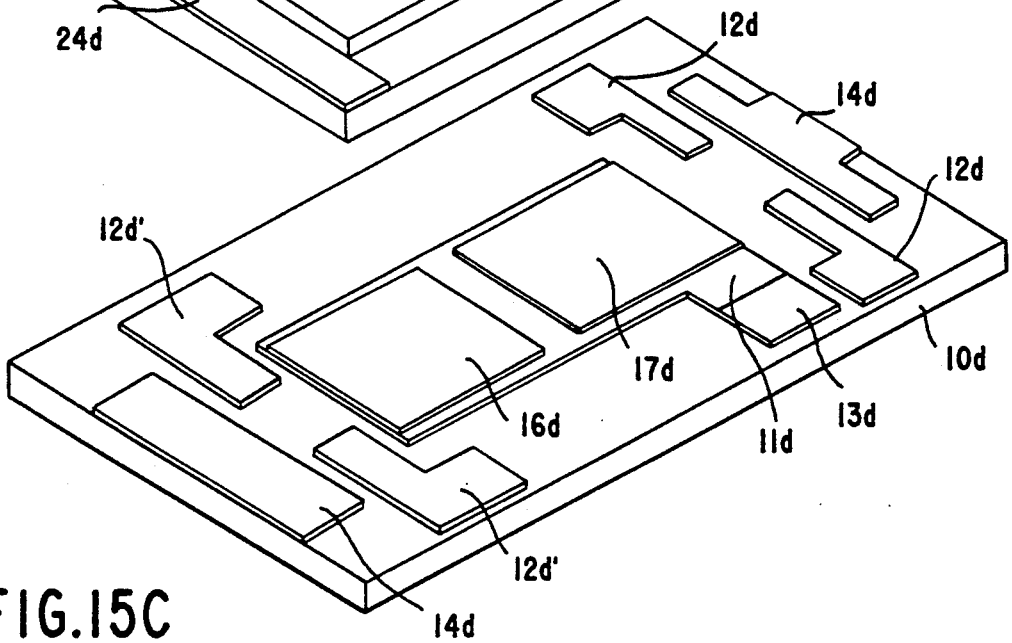
FIG.15C

ELECTROSTATIC RELAY

BACKGROUND OF THE INVENTION

1. Field of the Invention

The present invention relates to an electrostatic relay using a plurality of electrets which generate a strong electrostatic force for precisely and rapidly operating the relay.

2. Description of the Prior Art

Prior electrostatic relays using an electret do not have enough electrostatic force to move a movable element of the relay. For example, an electrostatic relay as described in U.S. Pat. No. 4,078,183 comprises two control electrodes between which is positioned a movable electret. The lower part of the movable electret is clampled as a cantilever by insulating shims, so that the movable electret can be moved between a position close to the electrode and a position close to the other electrode. Each of movable conductors is placed at the upper end of respective surface of the movable electrode. Two fixed conductors are arranged on the electrodes, respectively. The movable conductor can be contacted with the fixed conductors on the electrode by an electrostatic force which is generated by an impressed voltage between the electrode and the movable electret. The other movable conductor can be contacted with the fixed conductors on the other electrode by an electrostatic force which is generated by an impressed voltage between the other electrode and the movable electret. However, it is so difficult for the prior electrostatic relay to perform a monostable operation and also to obtain enough electrostatic force in order to move the movable electret. Therefore, the relay does not have enough electrostatic force for rapidly and precisely operating the relay.

SUMMARY OF THE INVENTION

The above problems and insufficiencies have been improved in the present invention which provides an improved electrostatic relay. The improved electrostatic relay of the present invention presents unique operation mechanism and a precise and rapid operation of the relay. The electrostatic relay comprises a fixed electrode with a fixed contact insulated therefrom, a movable electrode plate with a movable contact insulated therefrom, a fixed pair of oppositely charged first and second electrets, and also a control voltage source connected across the fixed electrode and the movable electrode plate to generate a potential difference therebetween. The movable plate is pivotally supported to pivot about a pivot axis to move relative to the fixed electrode between two rest positions of closing and opening the contacts. The first and second electrets are disposed adjacent the movable electrode plate to generate electrostatic forces of attracting and repelling the movable electrode plate, respectively when the movable electrode plate is charged to a given polarity. The attracting and repelling forces are cooperative to produce a torque for moving the movable electrode plate in one direction from one of the rest positions to the other. Therefore, the electrostatic relay has a high resistivity with respect to the impressed voltages to the movable electrode from the control voltage source, so that the relay operates precisely and rapidly.

Accordingly, it is a primary object of the present invention to provide an electrostatic relay which is capable of precisely and rapidly operating the relay.

In a preferred embodiment of the present invention, the movable electrode plate is pivotally supported at its one end in a cantilever fashion to move about the pivot axis at the one end and is provided with the second contact at the other end. The first and second electrets are positioned on the opposite side of the movable electrode plate between its ends. The movable electrode is moved by the attracting and repelling forces.

Therefore, it is a further object of the present invention to provide an improved electrostatic relay which is capable of sensitively responding with respect to impressed voltages from a control voltage source in such a manner as that a movable electrode is pivotally supported at its one end in a cantilever fashion and is moved by an attracting and repelling forces which result from electrets positioned on the opposite side of the movable electrode.

In a preferred embodiments of the present invention, the movable electrode plate is pivotally supported at its intermediate portion between its ends in a seesaw fashion to move about the pivot axis intermediates the ends of the movable electrode plate. And besides, the first and second electrets are positioned on the fixed electrode in such a manner as to be interposed between the fixed electrode and the movable electrode plate on opposite sides of the pivot axis, so that the movable electrode plate is moved by the attracting and repelling forces which result from the electrets, which is therefore a still further object of the present invention.

In a preferred embodiment of the present invention, the fixed electrode is supported on a fixed silicon plate with a first electrical insulation layer therebetween, and the movable electrode plate is a movable silicon plate with a second electrical insulation layer on a surface opposed to the fixed electrode. And besides, the first and second insulation layers carry thereon the first and second contacts, respectively. As a plate for supporting the fixed electrode and the movable electrode plate are made of silicon and have same thermal expansion coefficient, the relay has stable operation within a variation of a working temperature compared with a bimetal. On the other hand, the plates are readily and cheaply fabricated from a single silicon wafer with an ordinary machining unit for a semi-conductor by applying a photolithography technique.

Therefore, it is a further object of the present invention to provide an improved electrostatic relay which comprises a movable silicon plate and a fixed electrode plate supported on a fixed silicon plate, so that the relay has stable operation within a variation of a working temperature.

In a preferred embodiment of the present invention, the movable electrode plate extends from a frame and is pivotally supported thereto by way of a coupling segment defining the pivot axis. The electrode plate, the frame and the coupling segment are integrally formed from a silicon wafer into a unitary structure. The frame is mounted on the fixed silicon plate to have the movable electrode plate pivotable relative to the fixed silicon plate about the pivot axis. Therefore, the electrode plate, the frame and the coupling segment have a simple and unitary structure fabricated without processes of complex constructions, so that a performance of the relay is maintained for an extended time period, which is a still further object of the present invention.

In a preferred embodiment of the present invention, the fixed silicon plate is internally formed with at least one of an amplifying circuit to amplify the voltage from the control source voltage to apply an amplified voltage across the fixed electrode and the movable electrode plate, and also, a discharging circuit to discharge residual electrical charge from the fixed and movable electrodes. The amplifying circuit is useful to precisely operate the relay when the impressed voltage from the control source voltage is lowered. The discharging circuit is also useful for rapid and precise response of the relay when working numbers of the relay increase for a short time.

Accordingly, it is a further object of the present invention to provide an electrostatic relay which has an amplifying circuit and a discharging circuit to operate the relay precisely without a wrong operation.

In a preferred embodiment of the present invention, the first and second electrets are charged to such levels that the movable electrode plates are held stable at both of the two rest positions in the absence of the voltage difference between the fixed electrode and the movable electrode plate. Therefore, the electrostatic relay has a function of a bistable operation.

Therefore, it is another object of the present invention to provide an electrostatic relay which has electrets charged to appropriate charge levels for obtaining a bistable operation of the relay.

In a preferred embodiment of the present invention, the first and second electrets are charged to different absolute levels in the absence of the voltage difference between the fixed electrode and the movable electrode plate so as to generate the attracting forces of different levels which act on the movable electrode plates in the opposite directions. Therefore, The movable electrode plate is attracted toward one of the two rest positions and held it stably in that one position. For the same purpose, it is also preferred that the first and second electrets are of substantially the same charge density but formed into difference volumes so as to be charged to different absolute levels. And besides, it is useful that the first and second electrets are of substantially the same surface charge density but spaced from the movable electrode plate by different distances in the absence of the voltage difference between the fixed electrode and the movable electrode plate so as to generate the attracting forces of different levels which act on the movable electrode plates in the opposite directions. As described above, the electrostatic relay has a function of a monostable operation.

Therefore, it is a another object of the present invention to provide an electrostatic relay which has electrets charged to appropriate charge levels or spaced from a movable electrode plate by difference distances, or formed into difference volumes with the same charge density for obtaining a monostable operation of the relay.

BRIEF DESCRIPTION OF THE DRAWINGS

FIGS. 6A and 6B show two mechanical elements, respectively, which are a movable plate and a lower fixed plate, of an electrostatic relay in a third embodiment of the present invention;

FIGS. 12A and 12B show two mechanical elements, respectively, which are a movable plate and a lower fixed plate, of an electrostatic relay in a fourth embodiment of the present invention;

FIGS. 15A to 15C show three mechanical elements, respectively, which are an upper fixed plate, a movable plate, and a lower fixed plate, of an electrostatic relay in a fifth embodiment of the present invention;

DETAILED DESCRIPTION OF THE PREFERRED EMBODIMENTS

Embodiments of electrostatic relays of the present invention are explained below. However, the present invention is not limited by the embodiments.

First Embodiment <FIGS. 1 to 4>

Figure 1A:
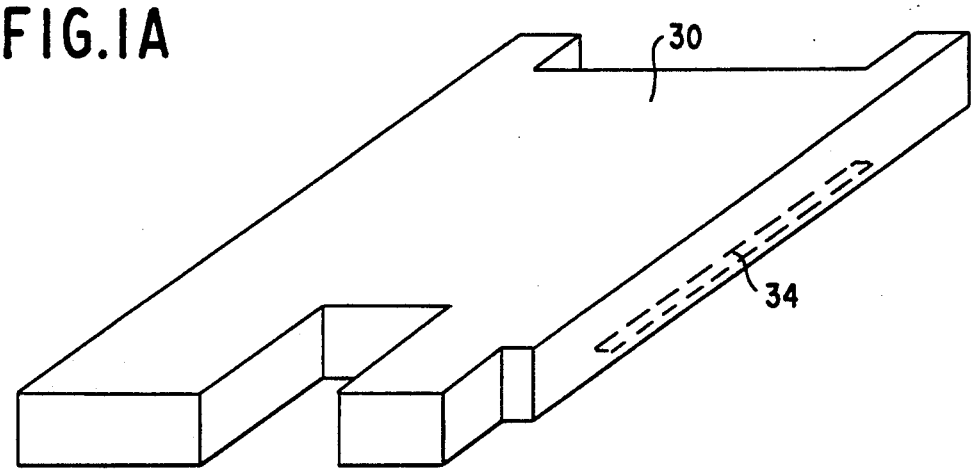
FIGS. 1A to 1C show three mechanical elements, respectively, which are an upper fixed plate, a movable plate, and a lower fixed plate, of an electrostatic relay in a first embodiment of the present invention.
Figure 1B:
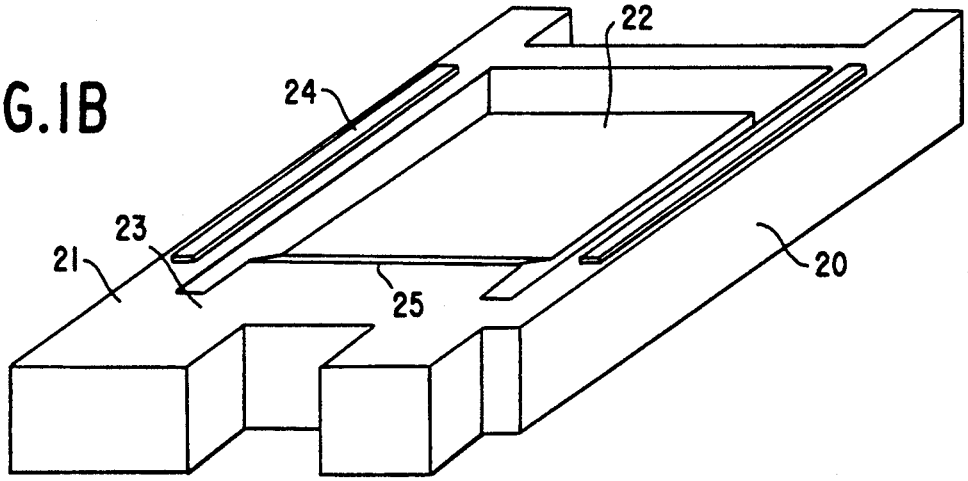
Figure 1C:
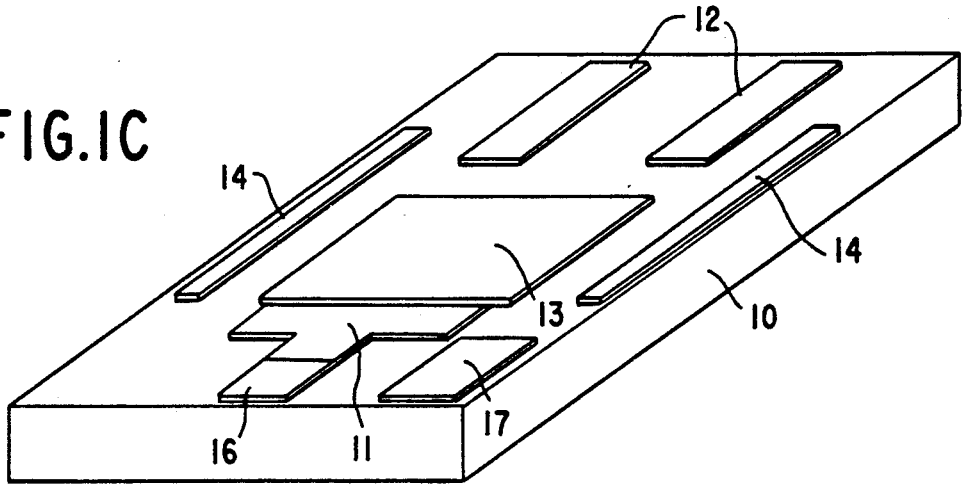
Figure 2:
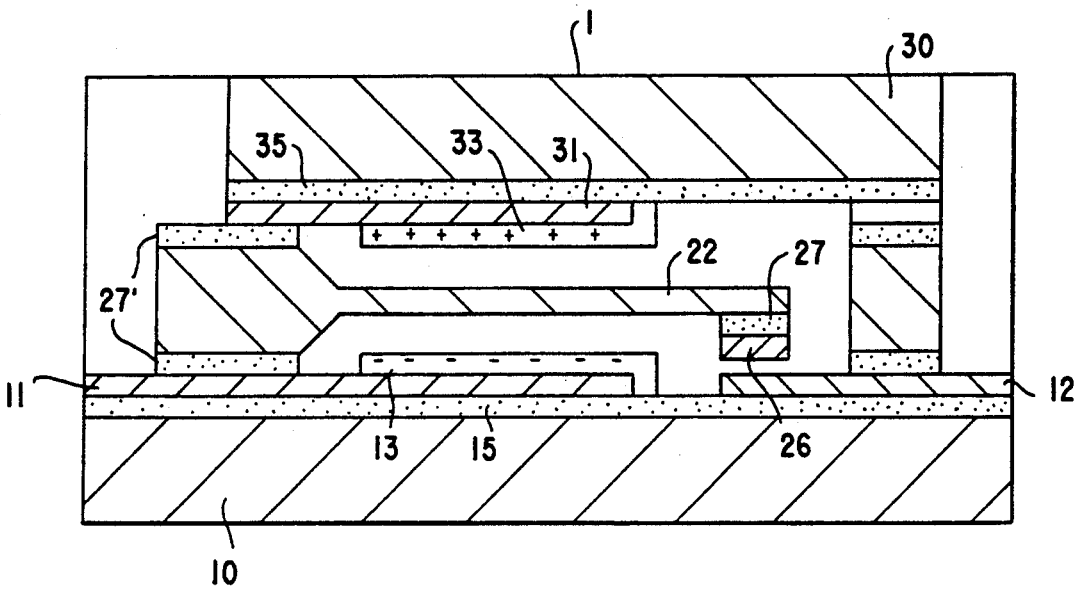
FIG. 2 shows a cross section of the electrostatic relay of the first embodiment.
Figure 3:
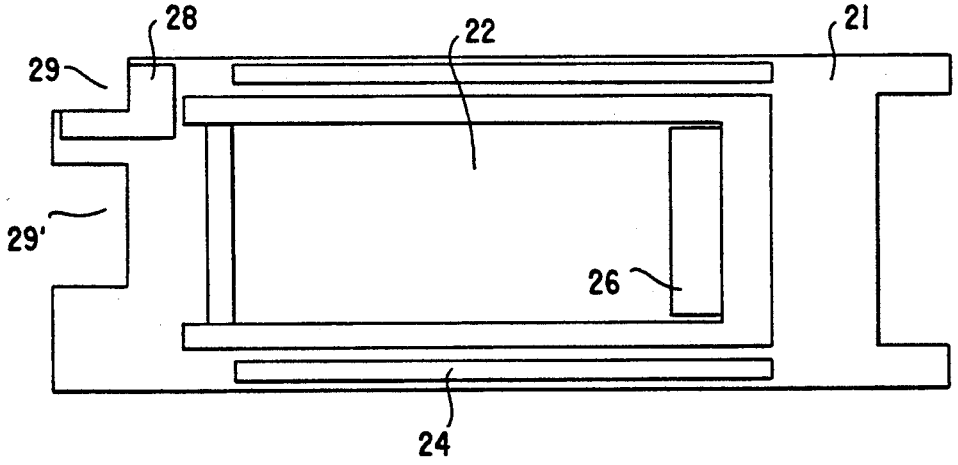
FIG. 3 shows a surface of the movable plate opposed to the lower fixed plate of the first embodiment.

An electrostatic relay of the present invention essentially consists of three mechanical elements, that is, a lower fixed plate 10, a movable plate 20, an upper fixed plate 30 as shown in FIGS. 1A, 1B and 1C. The three mechanical elements were bonded by gold alloy layers 14, 24 and 34 as shown in FIG. 2. Each of the plates is made of a single crystal of silicon. The lower fixed plate 10 has a fixed electrode 11 and a pair of fixed contacts 12, which are insulated from the lower plate 10 by an electrical insulation layer 15. An electrical insulation layer 27' is arranged on each surface of a frame 21 of the movable plate 20 in order to insulate the movable electrode 22 from the upper plate 30 and the lower plate 10. On the other hand, the upper fixed plate has a fixed electrode 31 which is insulated from the upper plate 30 by an electrical insulation layer 35. The movable plate is arranged between the upper and lower fixed plates and constituted by the frame 21, a movable electrode plate 22, a coupling segment 23 and a torsion bar 25, which are integrally formed from the silicon wafer into an unitary structure by an anisotropic etching of silicon. The torsion bar 25 with the movable electrode 22 are continuously connected with the frame 21 by the coupling segment 23 to form the unitary structure. The movable electrode plate 22 is pivotally supported at its one end in a cantilever fashion so as to move about the pivot axis at the one end and also has a movable contact 26 with an electrical insulation layer 27 at the other end and on a surface opposed to the lower fixed contacts 12 as shown in FIG. 2. Therefore, the electrostatic relay 1 of the present invention has one pair of the movable contact 26 and the fixed contacts 12. However, in an another case of the present invention, it is also preferred that an electrostatic relay has two pairs of a movable contact and a fixed contact when the movable contact is arranged at each surface of a movable electrode plate opposed to lower and upper fixed contacts, respectively. By the way, an upper electret 33 with positive charges is positioned on the upper fixed electrode 31. On the other hand, a lower electret 13 with negative charges is also positioned on the lower fixed electrode 11. A control voltage source (not shown) is connected with a terminal pad 28 of the movable plate 20 as shown in FIG. 3 and also with a terminal pad 16 of the lower fixed electrode 11 by a wire bonding in order to generate the potential difference between the movable electrode and the lower fixed electrode. A corner 29 and a part 29' of the movable plate 20 were cut off to readily perform the wire-bonding. The other terminal pad 17 which is also insulated from the lower fixed plate 10 is connected with the terminal pad 28 by bonding the movable plate 20 and the lower fixed plate 10. It is preferred that the upper or lower fixed plate 10 or 30 is internally formed with a driving circuit comprising at least one of an amplifying circuit to amplify the voltage from the control source voltage to apply an amplified voltage across the lower fixed electrode 11 and the movable electrode plate 22, and also, a discharging circuit to discharge a residual electrical charge from the lower fixed electrode 11 and the movable electrode 22. Therefore, the amplifying circuit and the discharging circuit are useful for stably and precisely operating the relay, and also are readily fabricated by applying a doping process as a well-known process of forming a semi conductor.

Figure 4:
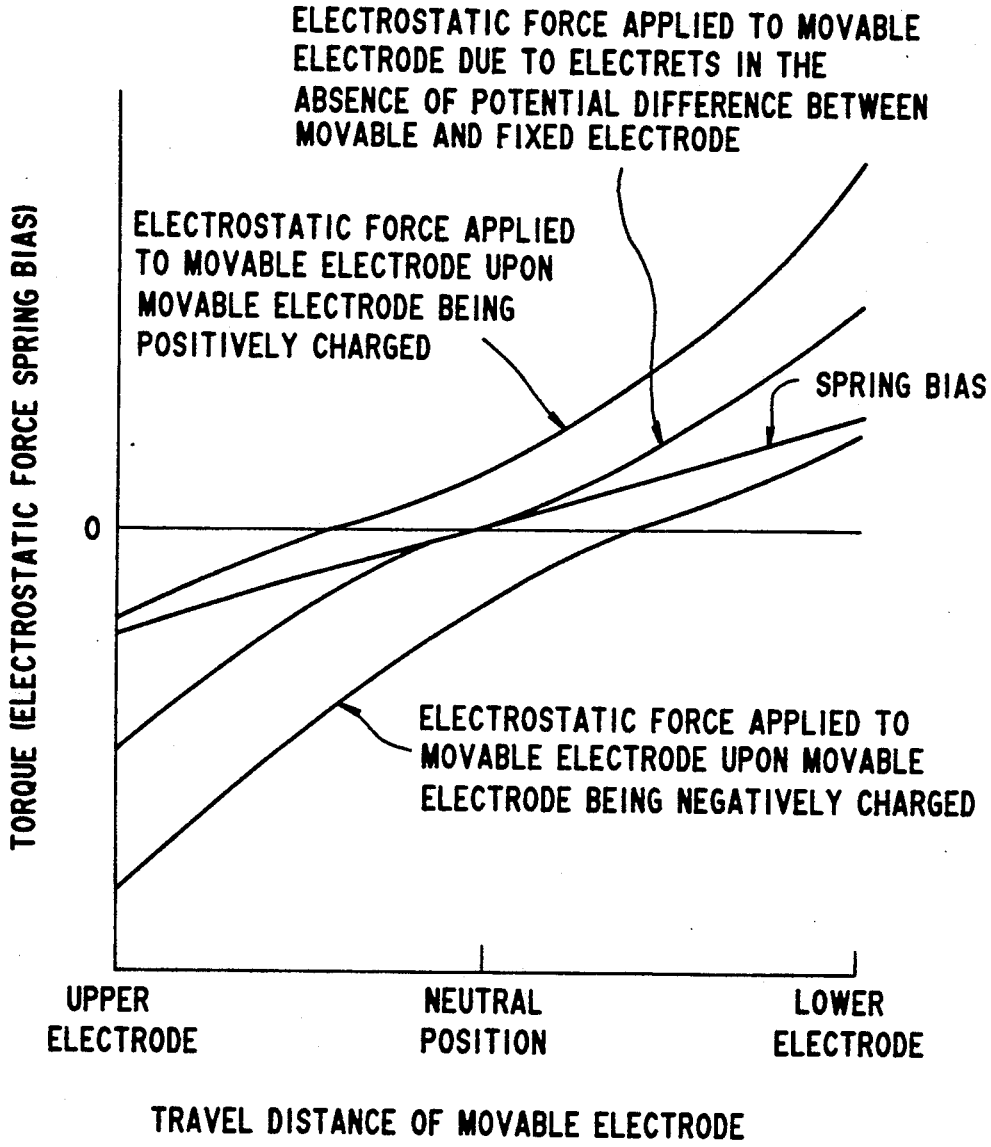
FIG. 4 is a somewhat schematic graph illustrating a bistable operation of the relay of the first embodiment.

A bistable operation of the electrostatic relay is explained below. The relay is formed such that the upper and lower electrets 13 and 33 are charged to the same level but have the opposite charges and are spaced from the movable electrode plate 22 by the same distance. FIG. 4 shows an electrostatic force generated in the absence of the potential difference between the lower fixed electrode and the movable electrode, electrostatic forces generated at when the impressed voltages are loaded to the relay having the function of the bistable operation, and a spring bias of the movable electrode, which vary with respect to a position of the movable electrode between the upper and lower electrode. The spring bias is approximately determined by a displacement of the movable electrode and its spring's modulus. The spring bias also works to the opposite direction of the electrostatic force, but, in the FIG. 4, the spring bias was shown to the same direction with the electrostatic force as a matter of convenience. As also shown in FIG. 2, when the movable electrode is spaced from and parallel with the upper and lower electrodes 31 and 11, respectively, by same distance, in the absence of the potential differences between them, the movable electrode is held at a center position between the electrodes. On the other hand, the electrostatic relay is also formed such that the electrostatic forces of the electrets 13 and 33, respectively, are larger than the spring bias. The movable electrode 22 receives the electrostatic force toward the upper electrode when the movable electrode is positioned close to the upper electret 33. Secondly, when a positive voltage is loaded to the movable electrode 22, the movable electrode receives strong electrostatic forces toward the lower electrode 11 which has the electret 13 with negative charges. Because an attracting force generated between the movable electrode 22 and the lower electret 13, and also a repelling force is generated between the movable electrode 22 and the upper electret 33. Therefore, both of the attracting and repelling forces cause the movable electrode 22 to move to the lower electret 13, so that the movable contact 26 connects with the fixed contacts 12. The, even if the positive voltage is removed from the movable electrode 22 again, the movable electrode 22 can not move to any other positions unless a negative voltage is loaded to the movable electrode. Similarly, when the negative voltage is loaded to the movable electrode 22, the movable electrode will receive the strong electrostatic forces toward the upper electrode 11. Therefore, the electrostatic relay of the present invention performs a bistable operation.

Figure 5:
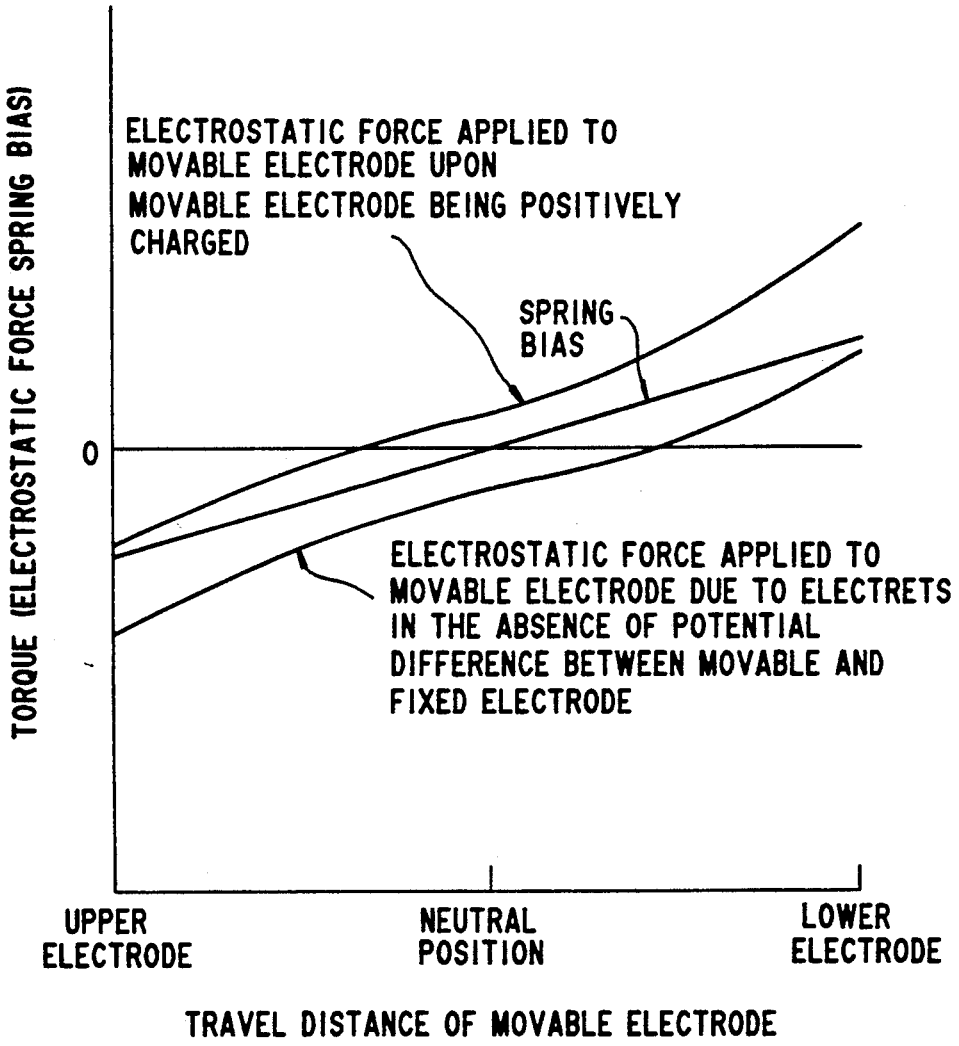
FIG. 5 is a somewhat schematic graph illustrating a monostable operation of the relay of a second embodiment.

Second embodiment <FIG. 5>

A second embodiment of the present invention is identical in structure to the first embodiment except that the relay is formed such that the upper and lower electrets 13 and 33, respectively, are charged to different absolute levels but have the opposite charge. Therefore, no duplicate explanation to common parts is deemed necessary. A monostable operation of the electrostatic relay is explained below. FIG. 5 shows an electrostatic force generated in the absence of the potential difference between the lower fixed electrode and the movable electrode, electrostatic forces generated at when the impressed voltages are loaded to the relay having the function of the monostable operation, and the spring bias of the movable electrode, which vary with respect to the position of the movable electrode between the lower and the upper electrode. The upper electret has larger absolute charge levels than the lower electret, which is the different point from the first embodiment. Therefore, the movable electrode receives the electrostatic force toward to the upper electret in the absence of the potential difference between them, so that the movable electrode approaches to the upper electret. Secondly, when the positive voltage is loaded to the movable electrode 22, the movable electrode receives a strong electrostatic force toward to the lower electrode 11. Because both of the attracting and repelling forces occur the movable electrode 22 to move toward to the lower electret 13, so that the movable contact 26 connect with the fixed contacts 12. By the way, as the electrostatic relay is formed such that the electrostatic force of the lower electret 13 is smaller than the spring bias, and also the electrostatic force of the upper electret 33 is larger than the spring bias in the absence of the potential difference between them, when the positive voltage is removed from the movable electrode again, the movable electrode 22 can stay away from the fixed contacts 12 immediately. Therefore, the electrostatic relay of the present invention performs the monostable operation.

Third embodiment <FIGS. 6 to 11>

Figure 9:
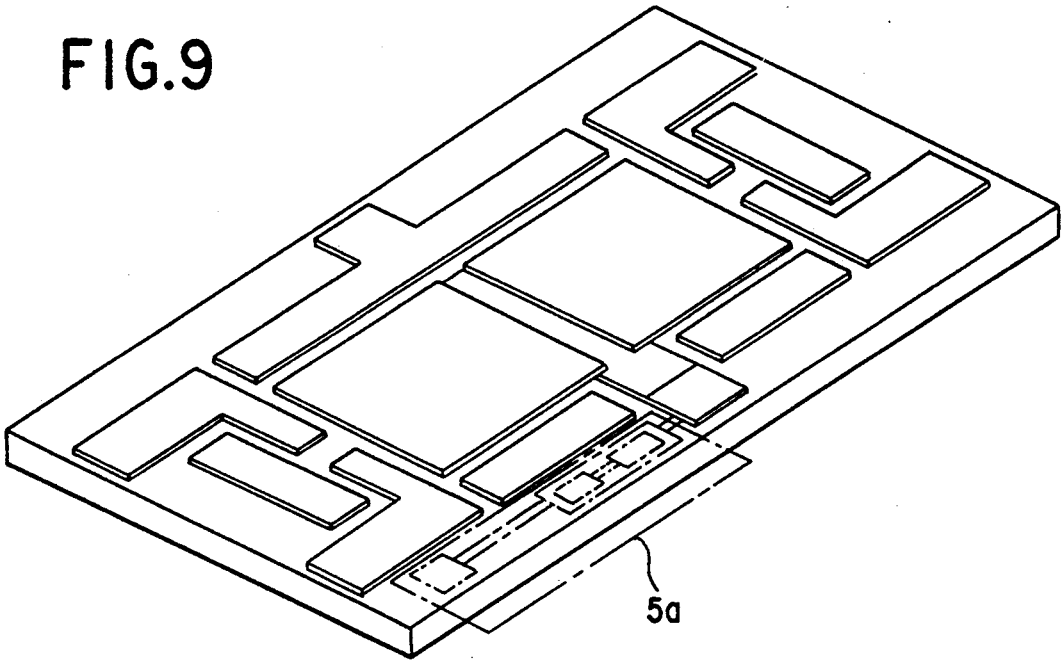
FIG. 9 shows a lower fixed plate having a driving circuit comprising at least one of an amplifying circuit and a discharging circuit of the third embodiment.
Figure 10:
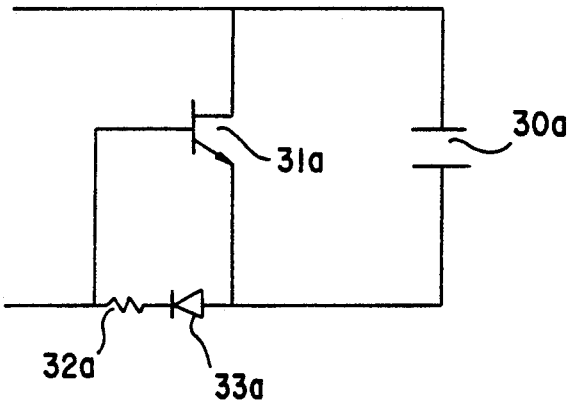
FIG. 10 shows a schematic circuit diagram of the driving circuit.

An electrostatic relay 1*a* of the present invention essentially consists of two mechanical elements, that is, a fixed plate 10*a* and a movable plate 20*a* as shown in FIG. 6*a* and 6*b*. Each of the plates was made of a single crystal of silicon. The two mechanical elements were bonded by gold alloy layers 14*a* and 24*a*. The movable plate 20*a* is arranged on the fixed plate 10*a* and constituted by a frame 21*a*, a movable electrode plate 22*a*, a coupling segment 23*a* and a torsion bar 25*a* which are integrally formed from the silicon wafer into an unitary structure by an anisotropic etching of silicon. The torsion bar 25*a* with the movable electrode 22*a* are continuously connected with the frame 21*a* by the coupling segment 23*a* to form the unitary structure. The movable electrode plate 22*a* is pivotally supported at its intermediate portion between its ends in a seesaw fashion so as to move about the pivot axis intermediates the ends of the movable electrode plate 22*a*. Each of movable contacts 26*a* and 26*a'* is arranged on the movable electrode plate with an electrical insulation layer 27*a* and at the ends of the movable electrode 22*a*, respectively as shown FIG. 2. A fixed electrode 11*a* and two pairs of fixed contacts 12*a* and 12*a'* are formed on the fixed plate with an electrical insulation layer 15*a*. The pair of the fixed contacts 12*a* is also arranged so as to have close and open positions between the pair 12*a* and the movable contact 26*a*. Similarly, the other pair 12*a'* is arranged so as to have close and open positions between the other pair 12*a'* and the other movable contacts 26*a'*. By the way, two electrets 16*a* and 17*a* are positioned on the fixed electrode 11*a* in such a manner as to be interposed between the fixed electrode and the movable electrode plate 22*a* on opposite sides of the pivot axis. The fixed electrets 16*a* and 17*a* have the opposite charges, respectively, in order to provide a torque for moving the relay. The control voltage source 30*a* is connected, by a wire bonding, with a terminal pad 28*a* of the movable plate 20*a* as shown in FIG. 6*a* and also with a terminal pad 13*a* of the fixed electrode 10*a* in order to generate the potential difference between the movable electrode and the fixed electrode. For the same reasons of the first embodiment, it is also preferred the fixed plate 10*a* is internally formed with a driving circuit 5*a* comprising at least one of an amplifying circuit and a discharging circuit as shown in FIG. 9. For example, as shown in FIG. 10, the driving circuit consists of a transistor 31*a*, a resistance 32*a* and a diode 33*a*.

Figure 7:
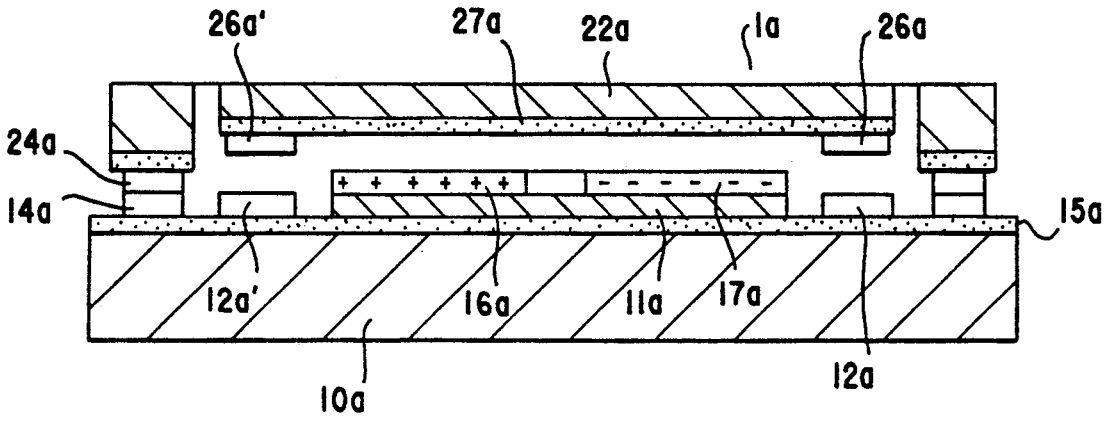
FIG. 7 shows a cross section of the electrostatic relay of the third embodiment.
Figure 8:
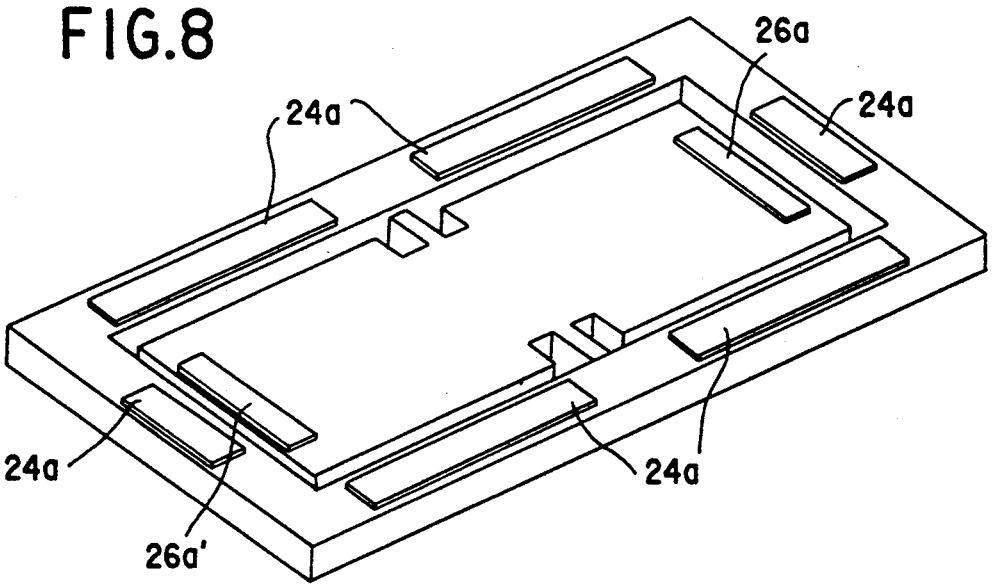
FIG. 8 shows a surface of the movable plate opposed to the fixed plate of the third embodiment.
Figure 11:
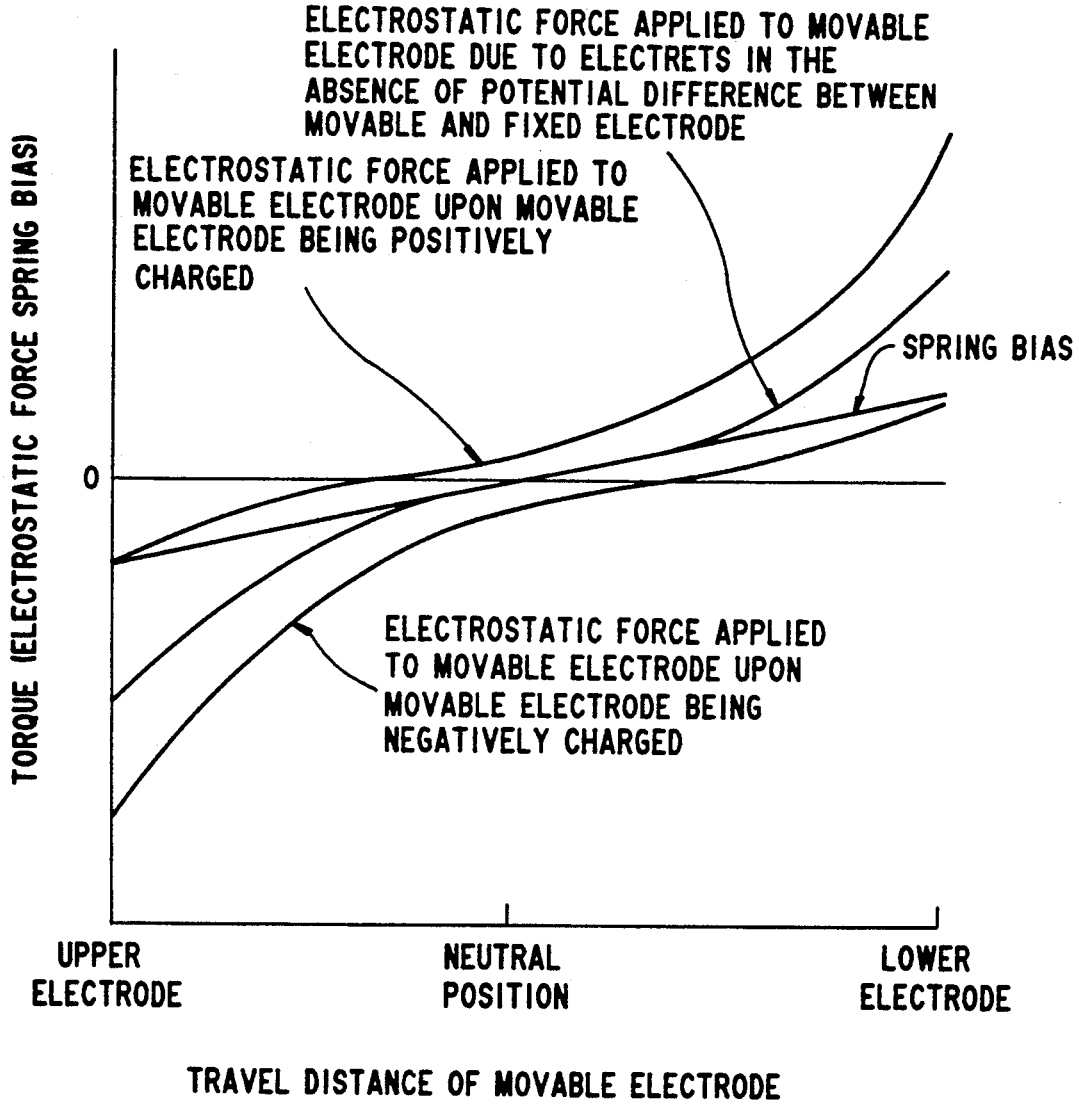
FIG. 11 is a somewhat schematic graph illustrating a bistable operation of the relay of the third embodiment.

A bistable operation of the electrostatic relay of the third embodiment is explained below. The electrostatic relay is formed such that the electrostatic forces of the electrets, respectively, is larger than the spring bias in the absence of the potential difference between the movable electrode 22*a* and the fixed electrode 11*a*, and also the fixed electrets are charged to same level but having the opposite charges, respectively. FIG. 11 shows an electrostatic force generated in the absence of the potential difference between them, electrostatic forces generated at when the impressed voltages are loaded to the relay having the function of the bistable operation, and a spring bias of the movable electrode 22*a*, which vary with respect to the positions of the movable electrode against the fixed plate 10*a*. The spring bias approximately determined by a displacement of the movable electrode and its spring's modulus. The spring bias works to the opposite direction of the electrostatic force, but, in the FIG. 11, the spring bias was shown to the same direction with the electrostatic force as a matter of convenience. As shown in FIG. 7, the electret 17*a* is charged to negative. Therefore, the other electret 16*a* is charged to positive. When a distance between the movable contact 26*a'* and the fixed contacts 12*a'* is smaller than that between the other movable contact 26*a* and the other fixed contacts 12*a* in the absence of the potential difference between them, the movable electrode 22*a* receives the electrostatic forces toward to the electret 16*a*, so that the movable contact 26*a'* connects with the fixed contact 12*a'*. Subsequently, when the positive voltage is loaded to the movable electrode 22*a*, the movable electrode 22*a* receives strong electrostatic forces toward to the electret 17*a*. Because an attracting force generates between the movable electrode 22*a* and the electret 17*a*, and also, a repelling force generates between the movable electrode 22*a* and the electret 16*a*. Therefore, both of the attracting and repelling forces occur the movable electrode 22*a* to move toward to the electret 17*a*. And then, the positive voltage is removed from the movable electrode again. However the movable electrode 22*a* can not move any more positions unless the negative voltage is loaded. Similarly, when the negative voltage is loaded to the movable electrode 22*a*, the movable electrode will receive the strong electrostatic forces toward to the electret 16*a*. Therefore, the electrostatic relay of the present invention performs the bistable operation.

Figure 13:
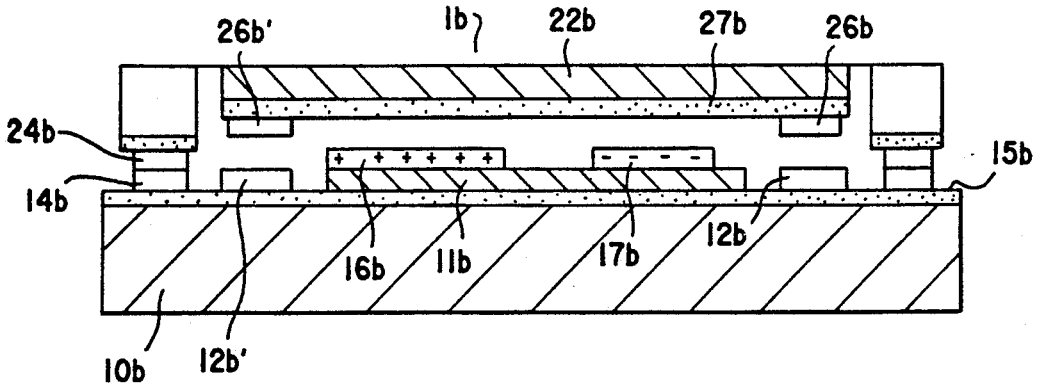
FIG. 13 shows a cross section of the electrostatic relay of the fourth embodiment.
Figure 14:
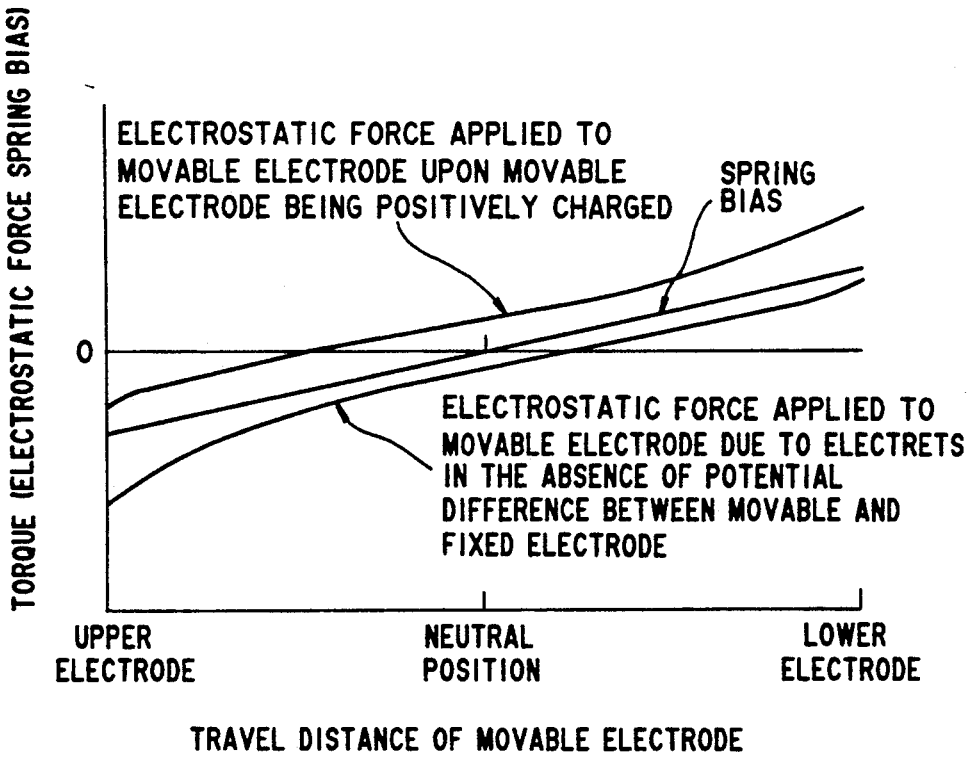
FIG. 14 is a somewhat schematic graph illustrating a monostable operation of the relay of the fourth embodiment.

Fourth embodiment <FIGS. 12 to 14>

A forth embodiment of the present invention is identical in structure to the third embodiment except that one of the two electrets has larger surface area compared with the other electret as shown in FIG. 12B. Therefore no duplicate explanation to common parts are deemed necessary. Like parts are designated by like numerals with a suffix letter of "b" in place of "a".

A monostable operation of the electrostatic relay of the embodiment is explained below. As shown in FIG. 12B, the electrostatic relay has a large electret 17*b* with the negative charges and a small electret 16*b* with a positive charges. As the electrets has the same charge density, the large electret 17*b* has a lot of absolute charge levels compared with the small electret. The relay is also formed such that the electrostatic force of the small electret 16*b* is smaller than the spring bias, and also the electrostatic force of the large electret 17*b* is greater than the spring bias in the absence of the potential difference between the movable electrode 22*b* and the fixed electrode 11*b*. When a distance between the movable contact 26*b'* and the fixed contacts 12*b'* is smaller than that between the other movable contact 26*b* and the other fixed contacts 12*b* in the absence of the potential difference between them, the movable electrode 22*b* receives the electrostatic force toward to the electret 16*b*, so that the movable contact 26*b'* connects with the fixed contacts 12*b'*. FIG. 14 shows an electrostatic force generated in the absence of the potential difference between them, electrostatic forces generated at when the impressed voltages are loaded to the relay having the function of the monostable operation, and the spring bias of the movable electrode 22*b*, which vary with respect to the positions of the movable electrode against the fixed plate 10*b*. Subsequently, when the positive voltage is loaded to the movable electrode 22*b* as shown in FIG. 13, the movable electrode receives strong electrostatic forces toward to the electret 17*b*. Because an attracting force generates between the movable electrode 22*b* and the electret 17*b*, and also, a repelling force generates between the movable electrode 22*b* and the electret 16*b*. Therefore, both of the attracting and the repelling forces occur the movable electrode to move toward to the electret 17*b*. And then, the positive voltage is removed from the movable electrode again, so that the movable electrode 22*b* can stay away from the fixed contacts 12*b* immediately and connect with the other contacts 12*b*'. Therefore, the electrostatic relay of the present invention performs the monostable operation.

Fifth embodiment <FIGS. 15 to 19>

Figure 16:
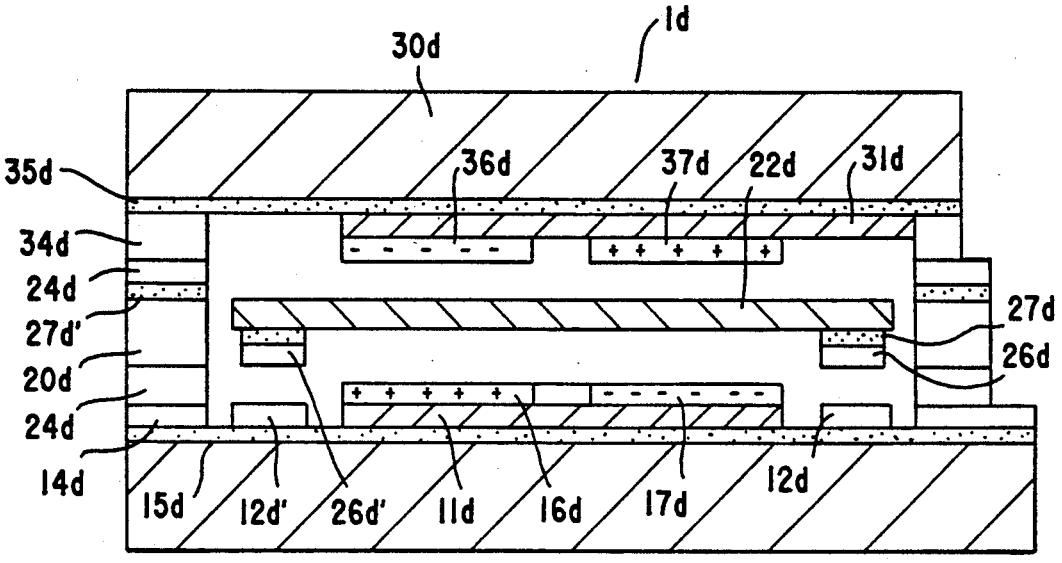
FIG. 16 shows a cross section of the electrostatic relay of the fifth embodiment.
Figure 17:
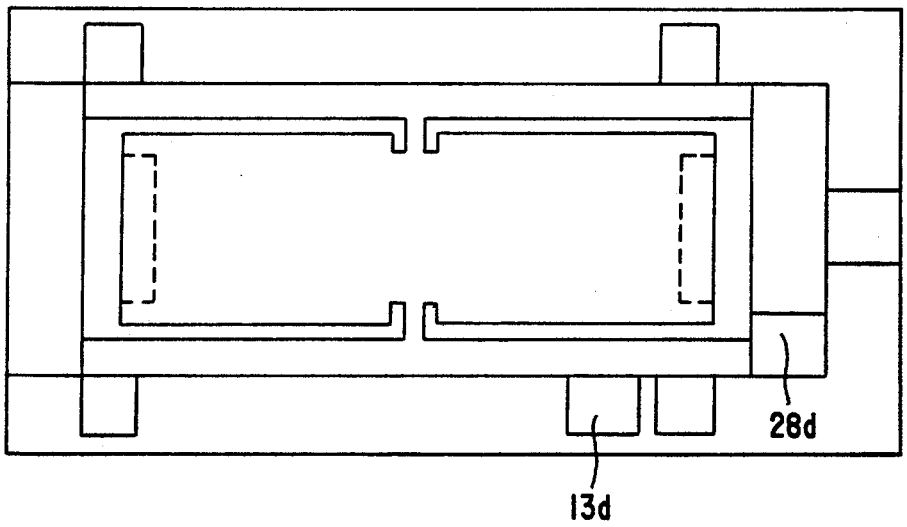
FIG. 17 shows an outline from the upper viewpoint of the movable plate bonded with the lower fixed plate of the fifth embodiment.
Figure 18:
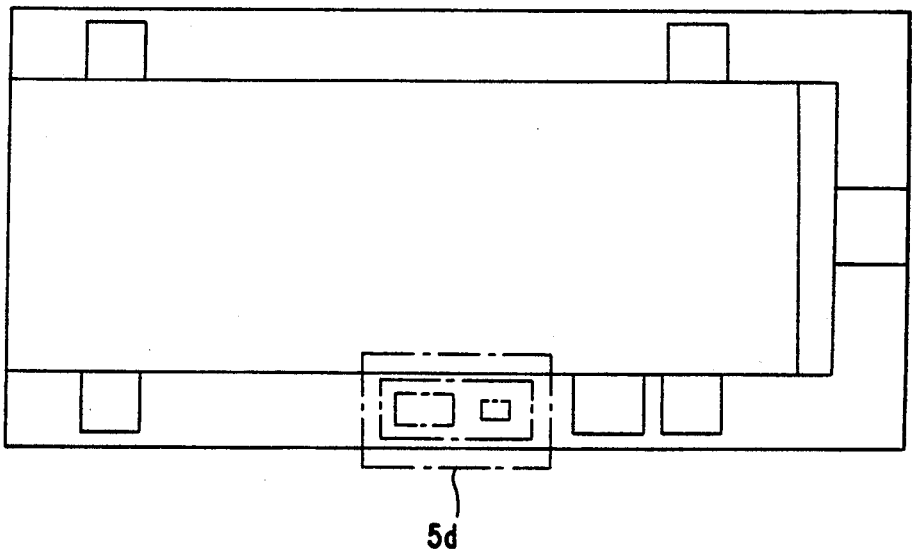
FIG. 18 shows an outline from the upper viewpoint of the electrostatic relay having a driving circuit of the fifth embodiment.

An electrostatic relay 1*d* of the present invention essentially consists of three mechanical elements, that is, a lower fixed plate 10*d*, a movable plate 20*d* and an upper fixed plate 30*d*, as shown in FIGS. 15A, 15B and 15C. Each of the plates was made of a single crystal of silicon. The three mechanical elements were bonded by gold alloy layers 14*d* and 24*d*. An electrical insulation layer 27*d*' is interposed between the gold layer 24*d* and the movable electrode 22*d* in order to insulate the upper electrode 31*d* from the movable plate 20*d*. A fixed electrode 11*d* and two pairs of fixed contacts 12*d* and 12*d*' are formed on the lower fixed plate 10*d* with an electrical insulation layer 15*d*. The pair of fixed contacts 12*d* is also arranged so as to have close and open positions between the pair and the movable contact 26*d*. Similarly, the other pair of the fixed contacts 12*d*' is arranged so as to have close and open positions between the other pair and the other movable contact 26*d*'. On the other hand, a fixed electrode 31*d* without fixed contacts are formed on the upper fixed plate 30*d* with an electrical insulation layer 37*d*. The movable plate 20*d* is positioned between the upper and the lower fixed plate 30*d* and 10*d*, and also constituted by a frame 21*d*, a movable electrode plate 22*d*, a coupling segment 23*d* and a torsion bar 25*d* which are integrally formed from the silicon wafer into the unitary structure by the anisotropic etching of silicon. The movable electrode plate 22*d* is pivotally supported at its intermediate portion between its ends in a seesaw fashion so as to move about the pivot axis intermediates the ends of the movable electrode plate 22*d*. Each of two movable contacts 26*d* and 26*d*' is arranged on the movable electrode plate with an electrical insulation layer 27*d* and at the ends of the movable electrode 22*d*, respectively as shown in FIG. 16. By the way, two lower electrets 16*d* and 17*d* are positioned on the lower fixed electrode 11*d* in the same manner as the third embodiment. The two lower electrets 16*d* and 17*d* have the opposite charges, respectively. On the other hand, the two upper electrets 36*d* and 37*d* are also positioned on the upper fixed electrode 31*d* in such a manner as to be interposed between the upper fixed electrode 31*d* and the movable electrode 22*d* on opposite sides of the pivot axis. The two upper electrets 36*d* and 37*d* have the opposite charges, and also the opposite charges with respect to the lower electrets, respectively, that is, when the lower electret 17*d* has the negative charges, the upper electret 37*d* has the positive charges as shown in FIG. 16. A control voltage source is connected, by a wire bonding, with a terminal pad 28*d* of the movable plate 20*d* as shown in FIG. 17 and also with a terminal pad 13*d* of the fixed electrode 10*d* in order to generate the potential difference between the movable electrode and the lower fixed electrode. For the same reasons of the first embodiment, it is preferred the fixed plate 10*a* is internally formed with a driving circuit 5*d* comprising at least one of an amplifying circuit and a discharging circuit as shown in FIG. 20.

Figure 19:
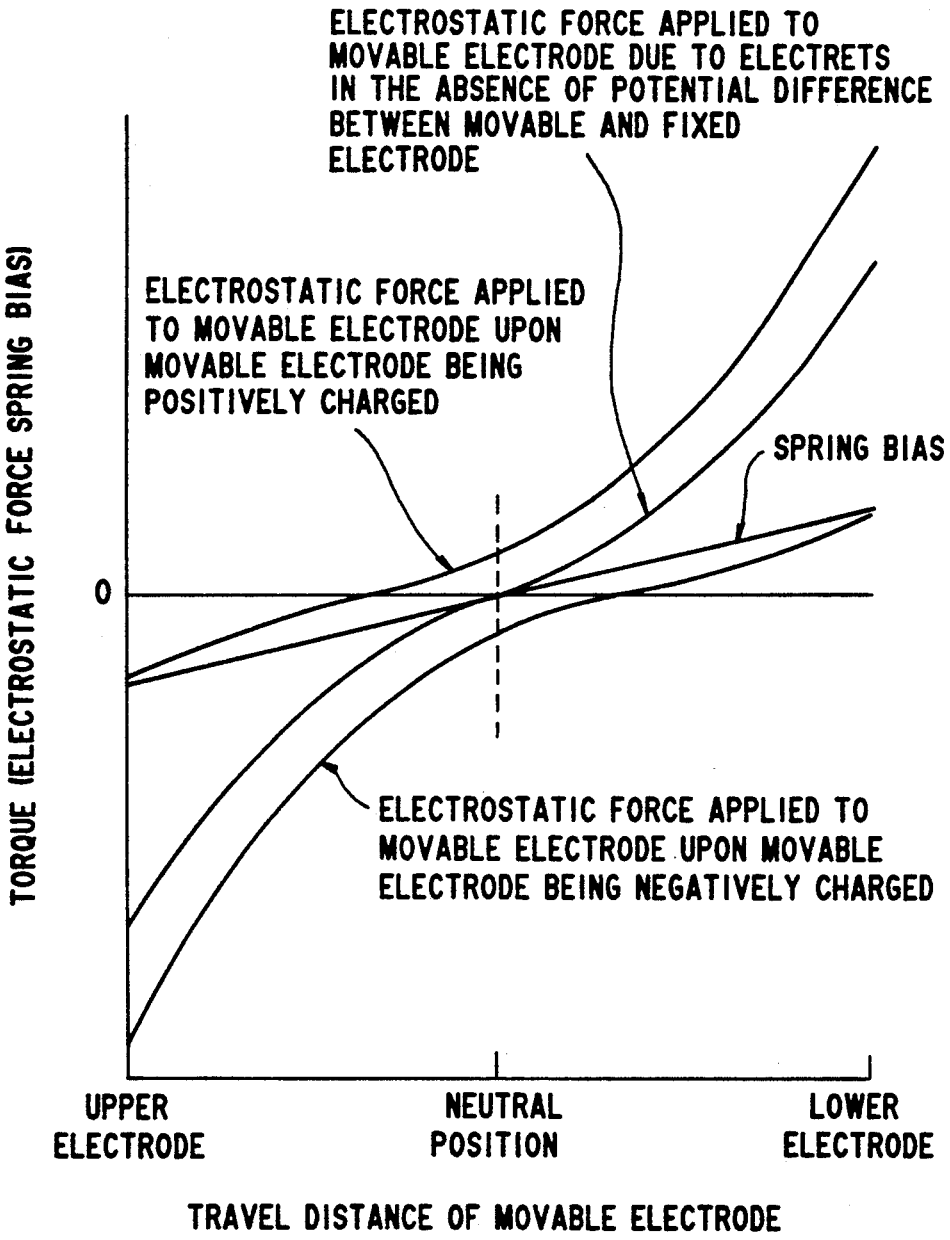
FIG. 19 is a somewhat schematic graph illustrating a bistable operation of the relay of the fifth embodiment.

A bistable operation of the electrostatic relay of the fifth embodiment is explained below. The electrostatic relay is formed such that the electrostatic force of the electrets, respectively, is larger than the spring bias of the movable electrode in the absence of the potential difference between the movable electrode 22*d* and the lower fixed electrode 11*d*. And also, all of the fixed electrets are charged to the same absolute charge levels and also spaced in parallel with the movable electrode 22*d* by same distance. FIG. 19 shows an electrostatic force generated in the absence of the potential difference between them, electrostatic forces generated at when the impressed voltages are loaded to the relay having the function of the bistable operation, and the spring bias of the movable electrode, which vary with respect to a position of the movable electrode 22*d* between the upper and lower electrode 11*d* and 31*d*. The spring bias also works to the opposite direction of the electrostatic force, but, in the FIG. 20, the spring bias was shown to the same direction with the electrostatic force as a matter of convenience. As shown in FIG. 16, the electrets 17*d* and 36*d* has the negative charges. Therefore, the other electrets 16*d* and 37*d* has the positive charges. When a distance between the movable contact 26*d* and the fixed contacts 12*d* is smaller than that between the other movable contact 26*d*' and the other fixed contacts 12*d*' in the absence of the potential difference between them, the movable electrode 22*d* receives the electrostatic forces toward to the electret 17*d*, so that the movable contact 26*d* connects with the fixed contact 12*d*. Subsequently, when the negative voltage is loaded to the movable electrode 22*d*, the movable electrode 22*d* receives an extremely strong electrostatic forces toward to the electrets 16*d* and 37*d*. Because attracting forces generate between the movable electrode 22*a* and the lower electret 16*d*, and also between the movable electrode and the upper electrode 37*d*, on the other hand, repelling forces generates between the movable electrode 22*d* and the lower electret 17*d*, and also between the movable electrode and the upper electret 36*d*. Therefore, both of the attracting and the repelling forces occur the movable electrode 22*d* to move toward to the electrets 16*d* and 37*d*. And then, even if the negative voltage is removed from the movable electrode 22*d* again, the movable electrode 22*a* can not move any more positions unless the positive voltage is loaded. Similarly, when the positive voltage is loaded to the movable electrode 22*d*, the movable electrode will receive the extremely strong electrostatic forces toward to the electrets 17*d* and 36*d*. Therefore, the electrostatic relay of the present invention performs the bistable operation.

Sixth embodiment

A sixth embodiment of the present invention is identical in structure to the fifth embodiment except that the electrostatic relay is formed such that the electrostatic forces of the electrets 17*d* and 16*d*, respectively is smaller than the spring bias of the movable electrode 22*d*, and also the electrostatic forces of the electrets 16*d* and 17*d*, respectively, is larger than the spring bias in the absence of the potential difference between the movable electrode 22d and the lower fixed electrode 11d. Therefore, no duplicate explanation to common parts are deemed necessary. A monostable operation of the electrostatic relay of the sixth embodiment is explained below. When a distance between the movable contact 26d and the fixed contacts 12d is smaller than that between the other movable contact 26d' and the other fixed contacts 12d' in the absence of the potential difference between them, the movable electrode 22d receives the spring bias, so that the movable contact 26d stays away from the fixed contacts 12d and at the same time, the movable contact 26d' connects with the fixed contacts 12d'. Subsequently, when the positive voltage is loaded to the movable electrode 22d, the movable electrode receives strong electrostatic forces, so that the movable contact 26d' stays away from the fixed contacts 12d' and the other movable contact 26d connects with the other fixed contacts 12d. Because both of the attracting and the repelling forces occur the movable electrode 22d to move toward to the electrets 36d and 17d. And then, when the positive voltage is removed from the movable electrode again, the movable contact 26d will stay away from the fixed contacts 12d immediately and at the same time, the movable contact 26d' will connect with the fixed contacts 12d' again. Therefore, the electrostatic relay of the present invention performs the monostable operation.

Although the above embodiments illustrate the terminal pad which is formed on the upper surface of the fixed silicon plate, it is equally possible to form the terminal pad on the lower surface of the silicon plate instead. In this case, the terminal pad is electrically connected to the fixed electrode on top of the silicon plate by way of a suitable conductor extending therethrough. On the other hand, although the above embodiments also show the fixed electrode formed on the fixed silicon plate with the electrical insulation layer, it is equally possible to form the fixed electrode on the silicon fixed plate itself instead. That is, when the fixed contact is electrically insulated from the fixed electrode by the insulation layer, there is no problem for the fixed electrode is the fixed silicon plate itself.

What is claimed is:

1. An electrostatic relay comprising:

a fixed electrode with a fixed contact insulated therefrom;

a movable electrode plate with a movable contact insulated therefrom, said movable plate being pivotally supported to pivot about a pivot axis to move relative to said fixed electrode between two rest positions of closing and opening said contacts;

a fixed pair of oppositely charged first and second electrets;

a control voltage source connected across said fixed electrode and said movable electrode plate to generate a potential difference therebetween;

said first and second electrets being disposed adjacent said movable electrode plate to generate electrostatic forces of attracting and repelling said movable electrode plate, respectively, when said movable electrode plate is charged to a given polarity, such that said attracting and repelling forces cooperate to produce a torque for moving said movable electrode plates in one direction from one of said rest positions to the other.

2. An electrostatic relay as set forth in claim 1, wherein said movable electrode plate is pivotally supported at its one end in a cantilever fashion to move about said pivot axis at said one end and is provided with said movable contact at the other end, said first electret is positioned adjacent said movable electrode plate and between opposite ends of said movable electrode plate.

3. An electrostatic relay as set forth in claim 1, wherein said movable electrode plate includes two opposite free ends and is pivotally supported at an intermediate portion between said two opposite free ends in a seesaw fashion to move about said pivot axis intermediate said two opposite free ends of said movable electrode plate, and said first and second electrets are positioned on said fixed electrode in such a manner as to be interposed between said fixed electrode and said movable electrode plate on opposite sides of said pivot axis.

4. An electrostatic relay as set forth in claim 1, wherein said first and second electrets are charged to such levels that said movable electrode plate is held stable at each of said rest positions in an absence of said potential difference between said fixed electrode and the movable electrode plate.

5. An electrostatic relay as set forth in claim 1, wherein said first and second electrets have substantially a same surface charge density but are spaced from said movable electrode plate by different distances such that, in an absence of said potential difference between said fixed electrode and said movable electrode plate, said first and second electrets generate attracting forces of different levels which act on said movable electrode plate in opposite directions, thereby attracting said movable electrode plate toward one of said two rest positions and holding it stably in that one position.

6. An electrostatic relay as set forth in claim 1, wherein said fixed electrode is a silicon plate with an electrical insulation layer thereon, said electrical insulation layer carrying said fixed contact.

7. An electrostatic relay as set forth in claim 1, wherein said first and second electrets are charged to different absolute levels such that, in an absence of said potential difference between said fixed electrode and the movable electrode plate, said first and second electrets generate attracting forces of different levels which act on said movable electrode plate in opposite directions, thereby attracting said movable electrode plate toward one of said two rest positions and holding it stably in that one position.

8. An electrostatic relay as set forth in claim 7, wherein said first and second electrets have substantially a same charge density but are formed into different volumes so that said first and second electrets are charged to different absolute levels.

9. An electrostatic relay as set forth in claim 1, wherein said fixed electrode is supported on a fixed silicon plate with a first electrical insulation layer therebetween, and said movable electrode plate is a movable silicon plate with a second electrical insulation layer on a surface opposed to said fixed electrode, said first and second insulation layers carrying thereon said fixed contact and said movable contact, respectively.

10. An electrostatic relay as set forth in claim 9, wherein each of said silicon plates is fabricated from a single crystal of silicon.

11. An electrostatic relay as set forth in claim 9, wherein said fixed silicon plate is internally formed with at least one of an amplifying circuit to amplify a voltage from said control source voltage to apply an amplified voltage across said fixed electrode and said movable electrode plate, and a discharging circuit to discharge residual electrical charge from said fixed and movable electrodes.

12. An electrostatic relay as set forth in claim 9, wherein said fixed silicon plate has on its bottom opposite to said movable electrode plate a terminal which is electrically connected through said fixed silicon plate to said fixed electrode and is provided as an electrical connection to said control voltage source.

13. An electrostatic relay as set forth in claim 9, wherein said movable electrode plate extends from a frame and is pivotally supported thereto by means of a coupling segment defining said pivot axis, said electrode plate, said frame and said coupling segment being integrally formed from a silicon wafer into a unitary structure, said frame being mounted on said fixed silicon plate to have said movable electrode plate pivotable relative to said fixed silicon plate about said pivot axis.

14. An electrostatic relay as set forth in claim 13, wherein said coupling segment gives a spring bias to urge said movable electrode plate from one of said rest positions to the other.

* * * * *